US009809427B2

(12) United States Patent
Randle

(10) Patent No.: US 9,809,427 B2
(45) Date of Patent: Nov. 7, 2017

(54) WIRE ROPE PROTECTION SLEEVE

(71) Applicant: Spoked Solutions LLC, Houston, TX (US)

(72) Inventor: Bryce Elliott Randle, Highlands Ranch, CO (US)

(73) Assignee: Spoked Solutions LLC, Houston, TX (US)

( * ) Notice: Subject to any disclaimer, the term of this patent is extended or adjusted under 35 U.S.C. 154(b) by 0 days.

(21) Appl. No.: 15/146,746

(22) Filed: May 4, 2016

(65) Prior Publication Data

US 2016/0325969 A1 Nov. 10, 2016

Related U.S. Application Data

(60) Provisional application No. 62/156,753, filed on May 4, 2015, provisional application No. 62/272,206, filed on Dec. 29, 2015.

(51) Int. Cl.
*B66C 1/12* (2006.01)

(52) U.S. Cl.
CPC ..... *B66C 1/122* (2013.01)

(58) Field of Classification Search
CPC ..... B66C 1/122
USPC ..... 294/74, 81.3, 81.4, 81.5; 410/41, 97, 99; 248/345.1
See application file for complete search history.

(56) References Cited

U.S. PATENT DOCUMENTS 3,310,333 A * 3/1967 Hutson ..... B64D 1/00 294/74
4,039,217 A * 8/1977 Bryant ..... B66C 1/122 294/74
4,045,072 A * 8/1977 Brown ..... B66C 1/18 294/74
4,402,489 A * 9/1983 Murray ..... A62B 1/18 182/230
4,441,748 A * 4/1984 St. Germain ..... B66C 1/122 294/74
5,603,591 A * 2/1997 McLellan ..... B60P 7/0823 410/97
5,887,923 A * 3/1999 Gardner, III ..... B65G 49/061 294/74
6,059,335 A * 5/2000 Matson ..... B66C 1/12 294/74
6,073,280 A * 6/2000 Farnum ..... A61F 5/03 294/74
7,744,138 B2 * 6/2010 St. Germain ..... B66C 1/122 294/74
9,597,996 B2 * 3/2017 Babinchak ..... B60P 7/0869
2003/0057409 A1 * 3/2003 Grapes ..... B66D 1/54 254/342
2008/0157549 A1 * 7/2008 St. Germain ..... B66C 1/122 294/74

(Continued)

*Primary Examiner* — Paul T Chin
(74) *Attorney, Agent, or Firm* — Sheridan Ross PC

(57) ABSTRACT

A protection sleeve is provided for a wire rope to prevent the wire rope from contacting other components in an oil and gas operation. The protection sleeve, in some embodiments, has a body that substantially corresponds to the wire portion of the wire rope, and the protection sleeve has specialized flaps at the ends of the body that correspond to thimble eyes of the wire rope. The protection sleeve may have a variety of configurations to accommodate different aspects of a wire rope or any other device that necessitates protection.

19 Claims, 2 Drawing Sheets

(56) References Cited

U.S. PATENT DOCUMENTS

| | | | | |
|---|---|---|---|---|
| 2011/0052314 | A1* | 3/2011 | Lindsey | B66C 1/12<br>403/210 |
| 2016/0046465 | A1* | 2/2016 | Babinchak | B60P 7/0869<br>294/74 |

* cited by examiner

WIRE ROPE PROTECTION SLEEVE

CROSS-REFERENCE TO RELATED APPLICATIONS

This application claims priority under 35 U.S.C. §119(e) to U.S. Provisional Patent Application Ser. No. 62/156,753 filed May 4, 2015 and U.S. Provisional Patent Application Ser. No. 62/272,206 filed Dec. 29, 2015, which are incorporated herein in their entireties by reference.

FIELD OF THE INVENTION

The invention relates to an apparatus and method for eliminating the potential for damage to occur to high-spec pipe and other equipment during handling operations when utilizing lifting equipment such as wire ropes. In particular, but not exclusively, the invention relates to a protection sleeve for, and a method of, reducing or eliminating contact between high-spec pipe and other equipment such as lifting equipment.

BACKGROUND OF THE INVENTION

Pipes such as casings, drillpipe, and other tubulars utilized in both oilfield and non-oilfield operations may have sensitive concentrations of various metals. For example, some casings and tubulars contain 13% Cr, 25% Cr, etc. that if contacted or damaged create imperfections, and become immediately susceptible to accelerated pitting, corrosion, and other chemical and non-chemical reactions that fast-track their failure of integrity. These imperfections may be acquired at the surface or downhole by slings slacked off from cranes and forklift forks during mobilization and handling of the casings and tubulars. To avoid these imperfections, non-metallic lifting equipment, or treated metallic lifting equipment is utilized to minimize or eliminate the potential for metal:metal contact. However, the ability to safely monitor this same equipment for fatigue is inefficient and may result in catastrophic failures causing loss of assets or life.

SUMMARY OF THE INVENTION

It is thus an aspect of embodiments of the invention to eliminate the metal:metal contact and still permit the proper inspection for the metal lifting equipment permitting ongoing usage. It is another aspect of embodiments of the invention to provide a retrofit that allows currently in-place equipment and procedure to continue to be utilized, thus meeting existing lifting standards and safety protocols. It is a further aspect of embodiments of the invention to provide a standalone wire rope protection sleeve that eliminates metal:metal contact and permits proper inspection of lifting equipment.

It is yet another aspect of embodiments of the invention to reduce or eliminate metal:metal contact between lifting equipment such as wire rope slings or lifting forks and equipment containing high spec metals such as casing, tubulars, or a combination thereof utilized in both oilfield and non-oilfield operations.

It is an aspect of certain embodiments of the invention to permit the easy installation and removal of the apparatus to permit inspection, monitoring, and recertification of lifting equipment as required by the user.

It is another aspect of embodiments of the invention to be adaptable and customizable to both currently existing and newly designed lifting equipment of various lengths, diameters, widths and configurations to aid in aftermarket adaptations.

It is a further aspect of embodiments of the invention to provide a wire rope protection sleeve that protects thimble eyes and master links.

It is another aspect of embodiments of the invention to provide a wire rope protection sleeve that eliminates the uncertainty of the condition of nylon straps for handling.

It is an aspect of embodiments of the invention to provide a wire rope protection sleeve that has a high strength hook and loop fastener (e.g., velcro) enclosure that resists extreme environmental conditions, including offshore or marine storms.

It is a further aspect of embodiments of the invention to provide a wire rope protection sleeve that has a high visibility structure to aid operators during day and night operations. This may include reflective surface areas or active illumination from light sources.

It is an aspect of embodiments of the invention to provide a wire rope protection sleeve that has many applications including, but not limited to, protection of hydraulic hoses from abrasive damage, identification of walkway hazards, and cable bundling and protection.

One embodiment of the invention is a device for reducing metal:metal contact in a pipe, comprising a pipe having a first end, a second end, and a length between the first end and the second end, the pipe having an outer surface; and a sleeve adapted to cover at least a portion of the outer surface of the pipe.

Another embodiment of the present invention is a system for reducing metal:metal contact, comprising a device having a body with a first end and a second end; a first component disposed on the first end of the body; a protection sleeve, comprising (1) a body having a first end and a second end, the body having an inner surface and an outer surface, the body extending substantially between the first end and the second end of the body of the device; (2) a body fastener positioned on the inner surface of the body, the body fastener configured to selectively interconnect to the outer surface of the body; (3) a flap having an inner surface and an outer surface, the flap disposed on the first end of the body of the protection sleeve; (4) a flap fastener positioned on the inner surface of the flap, the flap fastener configured to selectively interconnect to the outer surface of the flap; wherein in an assembled state, the body of the protection sleeve is positioned about the body of the device, and the flap of the protection sleeve is positioned about the first component of the device. In some embodiments, the device is a wire rope. In various embodiments, the component is a thimble eye.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the invention. Moreover, references made herein to "the invention" or aspects thereof should be understood to mean certain embodiments of the invention and should not necessarily be construed as limiting all embodiments to a particular description. The invention is set forth in various levels of detail in the Summary of the Invention as well as in the Detailed Description and no limitation as to the scope of the invention is intended by either the inclusion or non-inclusion of elements, components, etc. in this Summary of the Invention. Additional aspects of the invention will become more readily apparent from the Detailed Description.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

Figure 1A:
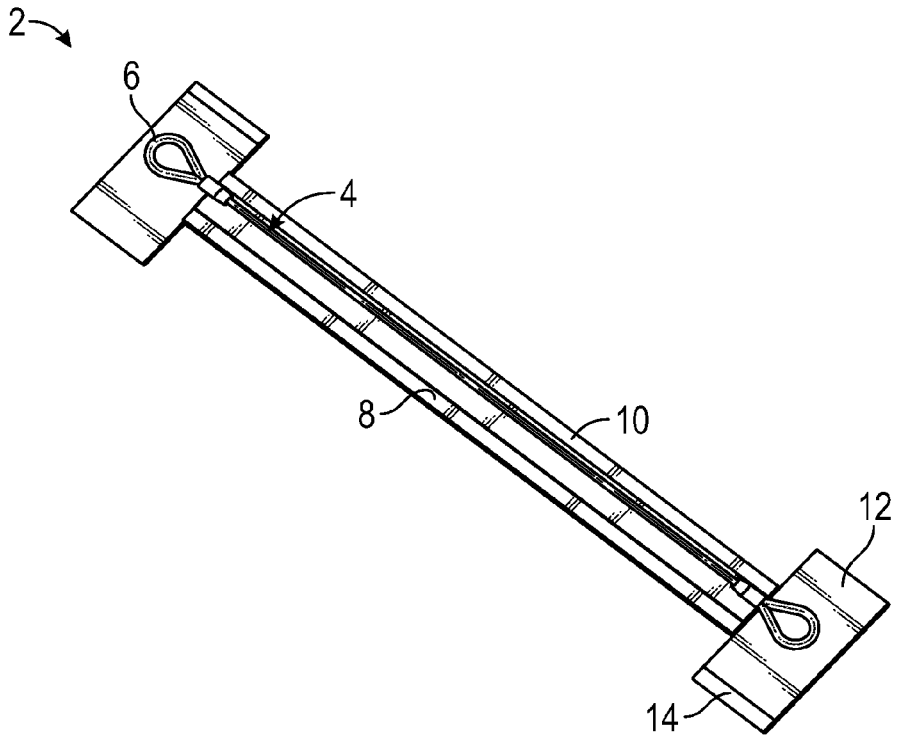
FIGS. 1A and 1B are perspective views of a wire rope and an unassembled protection sleeve in accordance with embodiments of the present invention.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

A list of the various components shown in the drawings and associated numbering is provided herein:

| Number | Component |
|---|---|
| 2 | Protection Sleeve |
| 4 | Wire Rope |
| 6 | Thimble Eye |
| 8 | Body |
| 10 | Body Fastener |
| 12 | Flap |
| 14 | Flap Fastener |

DETAILED DESCRIPTION

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the invention, a preferred embodiment that illustrates the best mode now contemplated for putting the invention into practice is described herein. The exemplary embodiment is described in detail without attempting to describe all of the various forms and modifications in which the invention might be embodied. As such, the embodiments described herein are illustrative, and as will become apparent to those skilled in the arts, and may be modified in numerous ways within the scope and spirit of the invention.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning.

Figure 1B:
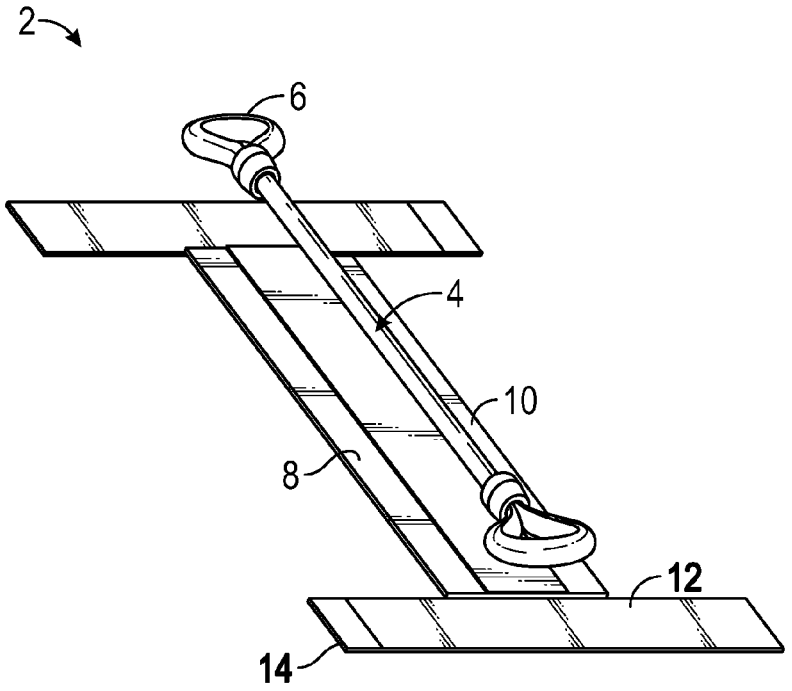

Now referring to FIGS. 1A and 1B, perspective views of a wire rope protection sleeve 2 are provided. Also provided is a wire rope 4 that has first and second ends with thimble eyes 6 positioned at each end. The thimble eyes 6 are loops that allow the wire rope 4 to be selectively interconnected to different equipment, for example, lifting equipment for oil and gas operations. It will be appreciated that other components, or no components at all, may be located at the ends of the wire rope 4. For example, end of the wire rope 4 may not comprise any additional components and the other end of the wire rope 4 may comprise a wire rope clip.

The protection sleeve 2 is configured to selectively assemble and disassemble around the wire rope 4 to prevent metal:metal contact between the wire rope 4 and components with sensitive metal compositions such as some casings and tubulars. In the embodiment shown in FIGS. 1A and 1B, the protection sleeve 2 has a body 8 substantially extending along the length of the wire rope 4. A flap 12 is disposed at either end of the body 8 of the protection sleeve 2. In some embodiments, the flaps 12 correspond to the thimble eyes 6 of the wire rope 4. It will be appreciated that the particular number and orientation of the flaps 12 may depend on the type of wire rope 4. For instance, in some embodiments, the protection sleeve 2 has only one flap 12 to correspond to one thimble eye 6 on the wire rope 4.

Fasteners are provided that allow the protection sleeve 2 to selectively interconnect upon itself to assemble around the wire rope 4. The body 8 of the protection sleeve 2 has a body fastener 10 extending along one side of the sleeve 2 and between two ends of the sleeve 2. When the protection sleeve 2 is assembled and the body 8 of the sleeve 2 is wrapped around the wire rope 4, the body fastener 10 selectively interconnects to the sleeve 2 itself. Similarly, the flaps 12 each have flap fasteners 14 running along one side of the flaps 12 and between two ends of the flaps 12. The flap fasteners 14 wrap around the thimble eyes 6 and selectively interconnect to the sleeve 2 itself.

Figure 2A:
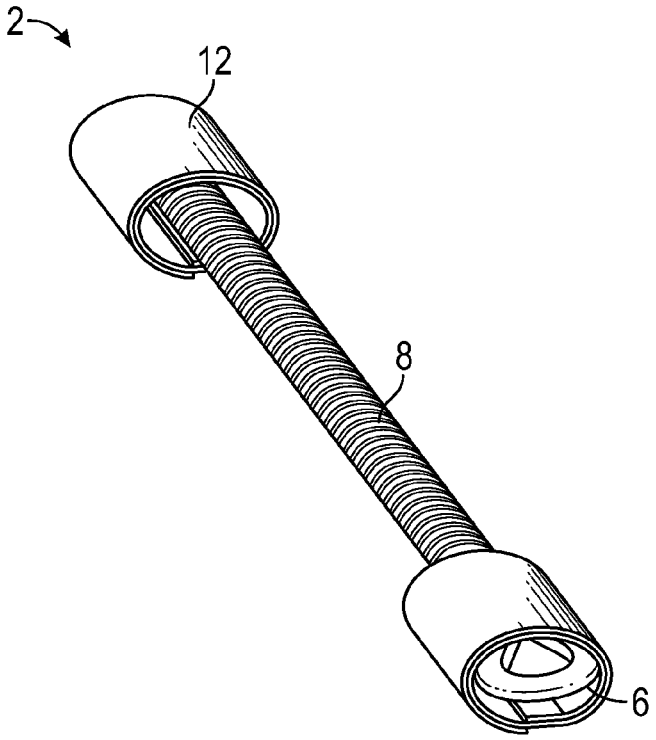
FIGS. 2A and 2B are perspective views of a wire rope and an assembled protection sleeve in accordance with embodiments of the present invention.
Figure 2B:
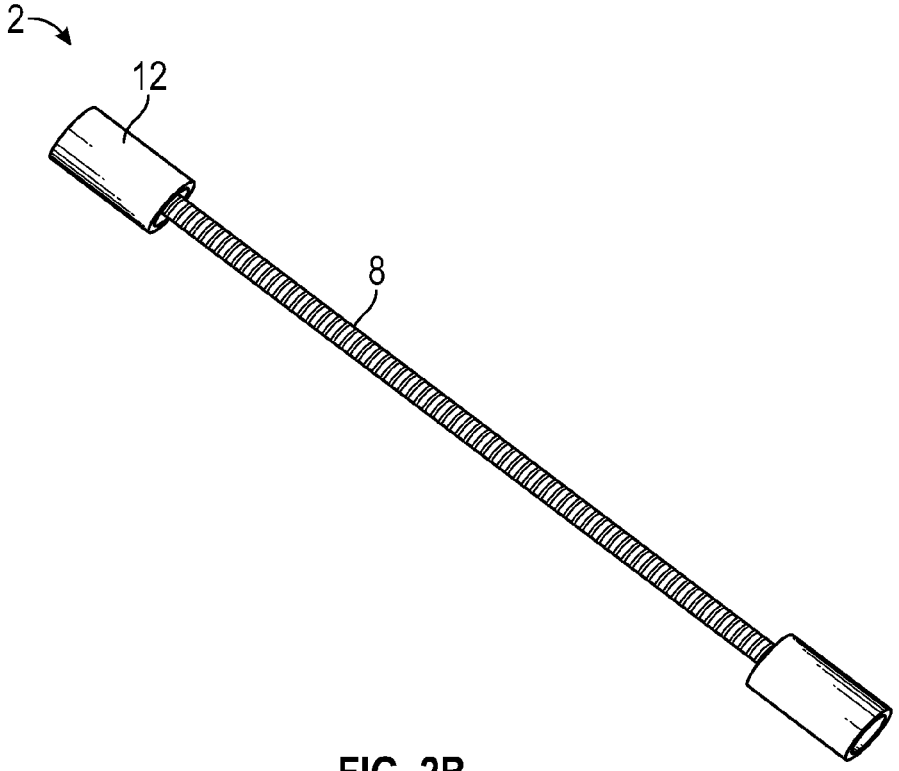

FIGS. 2A and 2B are perspective views of the protection sleeve 2 in an assembled state. The fasteners along the body and the flaps of the protection sleeve 2 have been selectively interconnected to the protection sleeve 2 itself. The fasteners may be typical hook and loop fasteners. However, the fasteners may be any type of fastener that provides a selective interconnection, including, but not limited to, buttons, zippers, clamps, clips, latches, pins, retaining rings, screws, snap fasteners, and threaded fasteners.

In addition, the fasteners may be disposed in a variety of locations on the protection sleeve 2 and in a variety of sizes and orientations. In some embodiments, the fasteners are positioned on the inner surface of the protection sleeve 2, as shown in FIGS. 1A and 1B. The fasteners then selectively interconnect to the outer surface of the protection sleeve 2, as shown in FIGS. 2A and 2B. In other embodiments, the fastener comprises two components such as hook and loop fasteners. One component is positioned on the inner surface of the protection sleeve 2, and the corresponding component is positioned on the outer surface of the protection sleeve 2. Thus, when the protection sleeve 2 is assembled, the two components of the fastener combine to form a selective interconnection. Once in an assembled state, the protection sleeve 2 prevents metal:metal contact between the wire rope 4 and any other metal apparatus, including drillpipe, casings, tubulars, etc.

It will be appreciated that while selective interconnections are discussed with respect to the protection sleeve 2, other embodiments may utilize permanent interconnections such as adhesives. It will further be appreciated that other embodiments may provide a protection sleeve 2 with no interconnections, wherein the protection sleeve 2 is installed by sliding the body 8 over wire rope 4.

The invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed.

The phrases "at least one", "one or more", and "and/or", as used herein, are open-ended expressions that are both conjunctive and disjunctive in operation. For example, each of the expressions "at least one of A, B, and C", "at least one of A, B, or C", "one or more of A, B, and C", "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification, drawings, and claims are to be understood as being modified in all instances by the term "about."

The term "a" or "an" entity, as used herein, refers to one or more of that entity. As such, the terms "a" (or "an"), "one or more" and "at least one" can be used interchangeably herein. The use of "including," "comprising," or "having," and variations thereof, is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts, and the equivalents thereof, shall include all those described in the summary of the invention, brief description of the drawings, detailed description, abstract, and claims themselves.

The foregoing description of the invention has been presented for illustration and description purposes. However, the description is not intended to limit the invention to only the forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Consequently, variations and modifications commensurate with the above teachings and skill and knowledge of the relevant art are within the scope of the invention. The embodiments described herein above are further intended to explain best modes of practicing the invention and to enable others skilled in the art to utilize the invention in such a manner, or include other embodiments with various modifications as required by the particular application(s) or use(s) of the invention. Thus, it is intended that the claims be construed to include alternative embodiments to the extent permitted by the prior art.

What is claimed is:

1. A protective sleeve for reducing metal to metal contact, comprising:

a body having a first end and a second end, the body having an inner surface and an outer surface;

a body fastener positioned on the inner surface of the body, the body fastener extending between the first and second ends of the body, and the body fastener configured to interconnect to the outer surface of the body;

a first flap having an inner surface and an outer surface, the first flap disposed on the first end of the body of the protection sleeve;

a first flap fastener positioned on the inner surface of the first flap, the first flap fastener configured to interconnect to the outer surface of the first flap;

a second flap having an inner surface and an outer surface, the second flap disposed on the second end of the body of the protection sleeve; and a second flap fastener positioned on the inner surface of the second flap, the second flap fastener configured to interconnect to the outer surface of the second flap.

2. The protective sleeve of claim 1, wherein the body fastener is configured to selectively interconnect to the outer surface of the body.

3. The protective sleeve of claim 2, wherein the body fastener selectively interconnects to the outer surface of the body using a hook and loop fastener.

4. The protective sleeve of claim 1, wherein the body fastener is configured to permanently interconnect to the outer surface of the body.

5. The protective sleeve of claim 1, wherein the protective sleeve is constructed from nylon.

6. The protective sleeve of claim 1, wherein the protective sleeve is substantially the same length as a wire rope with a predetermined length and the protective sleeve is configured to cover all metal surfaces of the wire rope.

7. A system for reducing metal to metal contact between a wire rope and a tubular, comprising:

a tubular;

a wire rope;

a protective sleeve that is substantially the same length as the wire rope, comprising:

a body having a first end and a second end, the body having an inner surface and an outer surface;

a body fastener positioned on the inner surface of the body, the body fastener configured to interconnect to the outer surface of the body;

a first flap having an inner surface and an outer surface, the first flap disposed on the first end of the body;

a second flap having an inner surface and an outer surface, the second flap disposed on the second end of the body;

wherein the inner surface of the protective sleeve contacts the wire rope and the outer surface of the protective sleeve contacts the tubular and the protective sleeve prevents contact between the wire rope and the tubular.

8. The system of claim 7, wherein the body fastener is configured to selectively interconnect to the outer surface of the body.

9. The system of claim 8, wherein the body fastener selectively interconnects to the outer surface of the body using a hook and loop fastener.

10. The system of claim 7, wherein the body fastener is configured to permanently interconnect to the outer surface of the body.

11. The system of claim 7, wherein the protective sleeve is constructed from nylon.

12. The system of claim 7, further comprising at least one of a thimble eye and a master link interconnected to a first end of the wire rope and the protective sleeve prevents contact between the thimble eye and the tubular and contact between the master link and the tubular.

13. The system of claim 7, wherein the body fastener extends between the first and second ends of the body.

14. A system for reducing metal:metal contact, comprising:

a device having a body with a first end and a second end;

a first component disposed on the first end of the body;

a protection sleeve, comprising:

a body having a first end and a second end, the body having an inner surface and an outer surface, the body extending substantially between the first end and the second end of the body of the device;

a body fastener positioned on the inner surface of the body, the body fastener configured to interconnect to the outer surface of the body;

a flap having an inner surface and an outer surface, the flap disposed on the first end of the body of the protection sleeve;

a flap fastener positioned on the inner surface of the flap, the flap fastener configured to interconnect to the outer surface of the flap;

wherein in an assembled state, the body of the protection sleeve is positioned about the body of the device, and the flap of the protection sleeve is positioned about the first component of the device.

15. The system of claim 14, wherein the device is a wire rope.

16. The system of claim 15, wherein the component is a thimble eye.

17. The system of claim 14, wherein the body of the protection sleeve is constructed from nylon.

18. The system of claim 14, wherein the body fastener selectively interconnects to the outer surface of the body of the protection sleeve using a hook and loop fastener.

19. The system of claim 14, wherein the body fastener extends between the first and second ends of the body of the protection sleeve.

* * * * *